US005221394A

United States Patent [19]

Epple et al.

[11] Patent Number: 5,221,394

[45] Date of Patent: Jun. 22, 1993

[54] METHOD FOR MANUFACTURING BACKED, PRESSURE-ADHERENT INDUSTRIAL CARPETING

[75] Inventors: Thomas C. Epple, Madison; Carol A. Caldwell, Kirtland Hills, both of Ohio

[73] Assignee: Avery International Corporation, Pasadena, Calif.

[21] Appl. No.: 535,474

[22] Filed: Jun. 8, 1990

[51] Int. Cl.[5] ..... B32B 31/00

[52] U.S. Cl. ..... 156/230; 156/231; 156/238; 156/272.6; 428/40

[58] Field of Search ..... 156/71, 72, 230, 231, 156/238, 241, 246, 249, 272.6, 247; 428/40, 95, 96

[56] References Cited

U.S. PATENT DOCUMENTS 3,962,386 6/1976 Driscoll ..... 156/272.6 X
4,242,389 12/1980 Howell ..... 428/40
4,695,493 9/1987 Friedlander et al. ..... 428/95 X

*Primary Examiner*—David A. Simmons
*Assistant Examiner*—James J. Engel, Jr.
*Attorney, Agent, or Firm*—Pearne, Gordon, McCoy & Granger

[57] ABSTRACT

A process of making backed, pressure-adherent carpeting. A construction is assembled comprising a backing-film and an adhesive on one side of the backing film, and then, in a separate step, the other side of the backing film is heat-laminated to a web of carpeting to thereby reinforce the carpeting and provide it with an adhesive. The carpeting is both reinforced and rendered adherent in a single pass of the carpeting and at a single station in the carpet-manufacturing line.

3 Claims, 1 Drawing Sheet

METHOD FOR MANUFACTURING BACKED, PRESSURE-ADHERENT INDUSTRIAL CARPETING

This invention relates to the manufacture of backed industrial carpeting of the type provided with a pressure-sensitive adhesive layer in association with the carpet backing. In backed carpeting of this type, the pressure-sensitive adhesive provides for convenient and efficient mounting or laying of the backed carpeting on the surfaces which it is to permanently cover. The invention also relates to a method for carpeting automotive interiors or other surfaces.

BACKGROUND

Carpeting of the grades utilized in applications such as automobile carpeting must have a low price/performance ratio to be competitively viable. Accordingly, the carpeting proper in the great majority of such applications is a relatively weak or flimsy web which is relatively cheap to manufacture and whose dimensional stability or tuft anchoring is provided in large part not by the carpeting alone but by a backing that is combined with the carpeting. Such carpeting may be a cut or uncut tufted carpeting or a needle-punch carpeting. The carpeting proper may include a "carrier," usually a non-woven web, or it may have no carrier. Sometimes tufted carpeting may have a woven carrier, but rely on a film backing for anchoring the tufts, Carpeting of this general kind may be referred to for present purposes as industrial carpeting even though its uses include consumer products such as automobiles.

As just stated, it is known to combine industrial carpeting with backing that renders the carpeting dimensionally stable. The backing may also contribute to anchoring of the pile and reduce bearding or wearing of the carpet. The carpeting may be in woven form but is usually needle-punched or tufted with cut or uncut pile. The general idea is to avoid the relatively high cost of manufacturing carpeting that is itself dimensionally stable, and instead use carpeting that in an unbacked state would be so fragile and lacking in dimensional integrity as to lack utility or have only limited utility, but that does perform adequately when combined with a reinforcing backing, such as a dimensionally stable film that is heat-laminated to or otherwise combined with the carpeting proper.

It is further known to combine backed industrial carpeting with a pressure-sensitive adhesive to provide a combined product that is pressure-adherent. That is to say, backed industrial carpeting is manufactured, and then a layer of pressure-sensitive adhesive is heat-laminated to the side of the backing that faces away from the carpeting proper. A protective release liner is provided on the side of the pressure-sensitive adhesive layer that faces away from the backing. In use, removal of the protective release liner from the pressure-sensitive adhesive layer renders the backed carpeting adhesive and allows the backed carpeting to be quickly and conveniently installed on floors, walls and other surfaces to be carpeted, such as for example on automobile interior surfaces during automobile manufacture.

One way that carpet manufacturers reinforce carpeting is by extruding a backing-film onto the back of the carpeting. An adhesive layer is then applied to the backing-film.

However, since the carpet fibers are often polypropylene with a low melt temperature, polyethylene is the only material which can be extruded to the back of the carpet without destroying the carpet itself. Polyethylene is also used due to its low cost and easy processability. However, the low surface energy of polyethylene results in a very weak adhesive bond between the carpet backing and the adhesive.

An alternate method to extruding the backing film onto the carpet is to laminate the backing film to the carpet. Backing film is made by a manufacturer specializing in film manufacture and is then supplied, directly or indirectly, to a carpeting manufacturer located elsewhere. The carpet manufacturer then heat laminates such backing film to the carpeting. This is followed by application of a pressure-sensitive adhesive to the exposed side of the backing film. The backing film in this process can be made of a material different than polyethylene; this can result in a better bond between the backing film and the adhesive.

Although advantageous, the procedure just described is subject to drawbacks. The backing-film and adhesive must be applied to the carpet by the carpet manufacturer in two passes of the carpeting or at two different stations on the carpet-manufacturing line.

BRIEF DESCRIPTION OF THE INVENTION

The present invention overcomes these drawbacks of the prior art. According to the invention, film-backed carpeting provided with pressure-sensitive adhesive is made by, in a first step, assembling a construction comprising a backing-film and a pressure-sensitive adhesive on one side of the backing film. This step may be performed by a manufacturer of pressure-sensitive adhesives, who may also manufacture the backing film or may acquire it from another source. Then, in a second step, which may be performed by the manufacturer of the carpeting proper, the other side of the backing film is heat-laminated to a web of carpeting to thereby, in a single pass of the carpeting and at a single station in the carpet-manufacturing line, reinforce the carpeting and provide it with a pressure-sensitive adhesive.

To be able to back the carpeting and render it pressure-adherent in a single pass and at a single station simplifies the manufacturing process for the manufacturer of backed, pressure-adherent industrial carpeting. Moreover, use of backing films which have superior bond between the carpet backing and the adhesive is also allowed. The bond of the adhesive to the film can also be improved with corona treatment of the surface of the backing film that receives the adhesive, thus further promoting bonding between the adhesive and film.

DETAILED DESCRIPTION OF THE INVENTION

The invention will be more fully understood from the detailed description given below, which refers to the accompanying drawings. The drawings are schematic and not to scale. In the drawings.

While the practice of the invention may be varied in many details, this detailed description is given by way of example. In this example, it will be understood that the operations illustrated in FIGS. 1–3 may be performed by a manufacturer of pressure-sensitive adhesives, who may also manufacture, as by an extrusion film-forming operation, or may purchase from a separate source, the backing film employed in the invention. The operation shown in FIG. 4 may be performed by the manufacturer of the carpeting proper, and the operation shown in FIG. 5 may be performed at an automobile manufacturing plant. These relationships of operations to sites will not always be necessary to the invention, but are intended to illustrate typical and advantageous uses of the invention.

Figure 1:
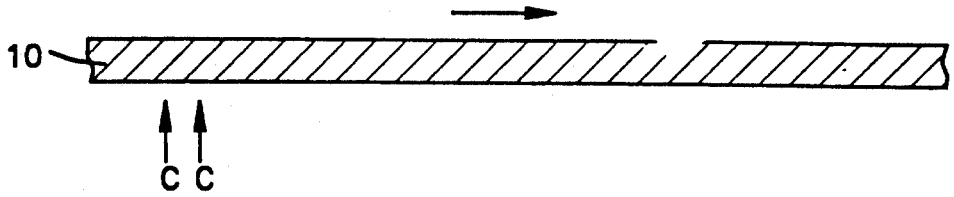
FIG. 1 is a fragmentary, cross-sectional view showing application of corona treatment to a backing film or laminate used in the invention.
Figure 2:
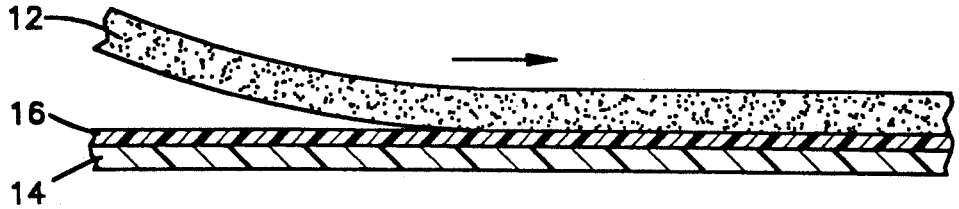
FIG. 2 is a fragmentary, cross-sectional view showing preparation of a pressure-sensitive adhesive by deposition on the release face of a release-coated liner.
Figure 3:
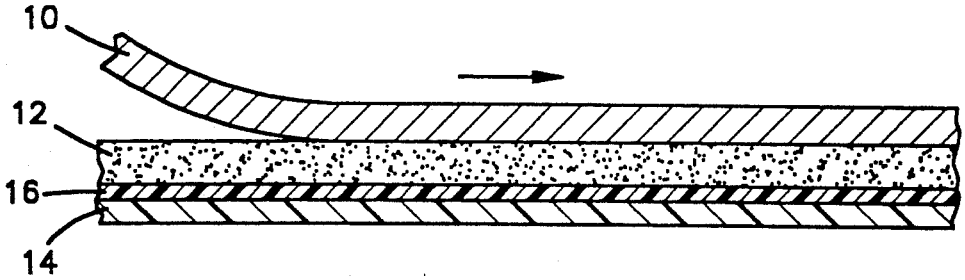
FIG. 3 is a view of the same type showing the backing film of FIG. 1 being combined with the freshly-prepared, liner-carried pressure-sensitive adhesive.

In the illustrated embodiment, the steps shown in FIGS. 1 and 2 are preparatory to the combining step shown in FIG. 3. FIGS. 1 and 2 relate to the preparation of two different components. These two different components are then combined in the operation of FIG. 3.

As shown in FIG. 1, a backing film 10 receives a corona discharge treatment, as schematically indicated by the arrows C, thereby enhancing bonding of the radiation-treated surface to a pressure-sensitive adhesive to which the film 10 is subsequently joined.

FIG. 2 illustrates the manufacture of a pressure-sensitive suitable for use in the practice of the invention. As shown, according to practices well known and suited to manufacturers of pressure-sensitive adhesives, an adhesive 12 may for example be extruded from a nozzle (not shown) and deposited as a layer on a supporting liner 14. The liner 14 may be a paper liner having a release coating 16 thereon as shown, or the liner may consist of or comprise a film having inherent release characteristics, or may be a film with a release face, layer or coating.

As shown in FIG. 3, the liner-supported adhesive 12 is then laminated to the surface of the backing film 10 which has received the radiation C to effect transfer-coating of the adhesive onto the backing film, and thereby assemble a construction comprising the backing film 10 with the adhesive 12 on one side thereof. It is noteworthy that this step may be, and preferably is, performed soon after the manufacture of the adhesive 12, so that the newly manufactured adhesive is still fresh when it is combined with the film 10, thereby enhance the permanent bonding between the adhesive 12 and the backing 10. If economics permit, manufacture of adhesive by extrusion and combining of the adhesive with the backing film 10 may be performed in sequence on the same manufacturing line.

Figure 4:
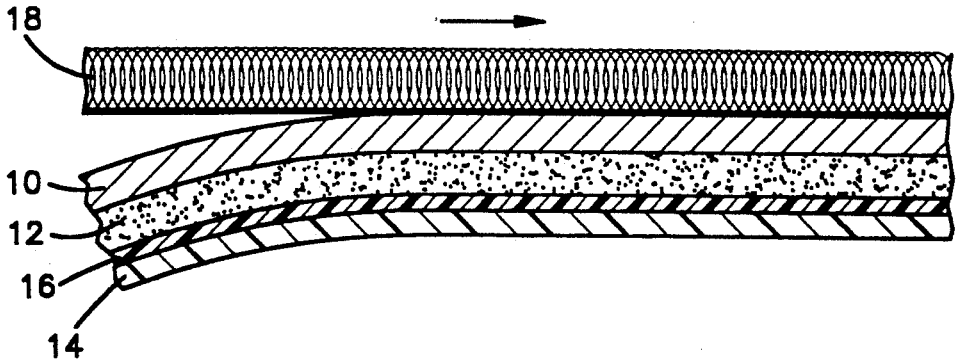
FIG. 4 is another view of the same type showing the construction of FIG. 3 being heat laminated to a web of carpeting as by a manufacturer of industrial carpeting.

The assembled construction shown in FIG. 3 is used by a carpet manufacturer in the manner shown in FIG. 4. The carpet manufacturer heat laminates the backing film 10 to the carpeting 18. The two webs contact each other at the interface between the underside of the carpeting 18 and the side of the backing film 10 opposite to the side that received the pressure-sensitive adhesive 12. The carpet manufacturer can often perform this step using substantially the same heat-laminating equipment as previously used to heat-laminate backing films per se to carpeting, so it will be understood that the use of the invention may require little or no modification of a carpet manufacturer's pre-existing equipment and procedures.

By the single operation shown in FIG. 3, the carpet manufacturer both accomplishes the reinforcement of the carpeting and provides it with an adhesive. This can be done in a single pass of the carpeting and at a single station in the carpet manufacturing line. No additional coating or laminating steps are required. Furthermore, the bond between the adhesive 12 and backing 10 is stronger than that achieved in conventional practice where the carpet manufacturer applies a reinforcing backing to the carpeting and then laminates a liner-carried pressure-sensitive adhesive to the backing.

Figure 5:
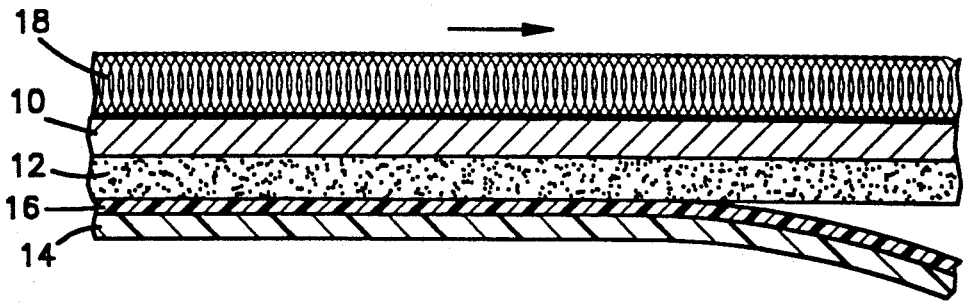
FIG. 5 is also a view of the same type showing the use of the construction produced by the steps of FIGS. 1–4 in its end-use application, as for example used by a worker at an automobile manufacturing plant.

FIG. 5 shows the use of the construction produced by the steps of FIGS. 1–4 in its end-use application. The liner 14 with its release coat 16 is separated from the adhesive carpeting to expose the adhesive which is the applied to the surface to receive the carpeting, as for example the walls or floor of an automobile interior. This step may be the same as performed with adhesive carpeting produced by conventional methods, so no retraining of production line workers is required, and no "learning curve" need be travelled to learn any new or modified procedure.

The following examples of the invention were made and tested.

EXAMPLE 1

A 5 mil thick coextruded backing film consisting of 3.5 mils ethylene vinyl acetate and 1.5 mils polypropylene supplied by Exxon was corona treated on the polypropylene side. A pressure-sensitive adhesive of a solvent-based radiation-cured type was then provided. (See U.S. Pat. No. 4,820,746, incorporated herein by reference.) The adhesive comprised the following base in parts by weight:

19.3 SBS linear copolymer, about 31% styrene
16.1 SB copolymer
25.8 Alpha pinene tackifier
32.3 Rosin ester tackifier
6.4 Compatible aromatic liquid resin 0.4 percent by weight of trimethylolpropanetrithioglycolate was mixed with the foregoing as a crosslinking additive. Antioxidants were also included. The adhesive was coated onto a release liner, dried at about 210 degrees F. for 6 minutes, and electron-beam radiated at a dosage of 50 kGy to cure. The liner-supported adhesive was then applied to the polypropylene side of the backing film to thereby transfer the adhesive onto the backing film. The adhesive coating was 5 mils thick before and after transfer. The backing film was then heat-bonded on its ethylene vinyl acetate side to Chrysler JB839 needlepunch carpeting, which has no carrier. The resulting construction was then divided into three samples. The adhesive sides of two samples were applied to a polypropylene substrate and allowed to dwell for 72 hours at room temperature. (The polypropylene substrate was used because polypropylene is often the substrate material in automobile door panels to which carpeting is to be applied.) The two samples were then tested for 180 degree peelback adhesive strength under the following circumstances: sample 1, no further treatment; sample 2, exposure to 180 degree F. environment for 17 hours followed by a recovery time before test of 1 minute. Adhesive test procedures in this and subsequent tests were in accordance with General Motors test procedure GM3608M. The samples exhibited the following adhesive strengths (pounds per lineal inch): Sample 1, 2.42; sample 2, 0.17. The fiber pull strength of the third sample was tested and found to be 7.60 pounds. Fiber pull strengths were tested in accordance with ASTM D-1335 in this and subsequent examples.

EXAMPLE 2

Same as example 1 except that the backing film was heat bonded to General Motors Thaxton tufted carpeting, which has a non-woven carrier. The resulting two samples exhibited the following adhesive strengths: Sample 1, 3.54; sample 2, 0.52. The tuft pull strength of the third sample was tested and found to be 8.32 pounds.

EXAMPLE 3

Same as example 1 except that the backing film was heat bonded to Ford ESB-M3H50-A2 tufted carpeting, which has a non-woven carrier. The resulting two samples exhibited the following adhesive strengths: Sample 1, 3,58; sample 2, 0.75 pounds. The tuft pull strength of the third sample was tested and found to be 9.35 pounds.

EXAMPLE 4

A 2.5 mil thick polyethylene film supplied as "303 Resin" by Polypac was corona treated on one side. The same adhesive as in example 1 was prepared in the same manner, but to a different coating thickness. The liner-supported adhesive was then applied to the corona-treated side of the backing film to thereby transfer the adhesive onto the backing film. The adhesive coating was 10 mils thick before and after transfer. The backing film was then heat-bonded on its other side to Chrysler JB839 needlepunch carpeting. The resulting construction was then divided into three samples. The adhesive sides of the first two samples were applied to a polypropylene substrate and allowed to dwell for 72 hours at room temperature. The two samples were then tested for adhesive strength under the following circumstances: sample 1, no further treatment; sample 2, exposure to 180 degree F. environment for 17 hours followed by a recovery time before test of 1 minute. The samples exhibited the following adhesive strengths (pounds per lineal inch): Sample 1, 4.27; sample 2, 1.27. The fiber pull strength of the third sample was tested and found to be 8.80 pounds.

EXAMPLE 5

Same as example 4 except that the film was heat bonded to General Motors Thaxton tufted carpeting. The resulting first two samples exhibited the following adhesive strengths: Sample 1, 4.67; sample 2, 1.33. The tuft pull strength of the third was tested and found to be 7.08 pounds.

EXAMPLE 6

Same as example 4 except that the film was heat bonded to Ford ESB-M3H50-A2 tufted carpeting. The resulting first two samples exhibited the following adhesive strengths: Sample 1, 7.72; sample 2, 1.38. The tuft pull strength of the third sample was tested and found to be 9.34 pounds.

EXAMPLE 7

Same as example 4 except that the film thickness was 4 mils before and after transfer. The resulting first two samples exhibited the following adhesive strengths: Sample 1, 4.41; sample 2, 1.00. The tuft pull strength of the third sample was tested and found to be 7.80 pounds.

EXAMPLE 8

Same as example 5 except that the film thickness was 4 mils before and after transfer. The resulting first two samples exhibited the following adhesive strengths: Sample 1, 4.6; sample 2, 1.23. The tuft pull strength of the third sample was tested and found to be 7.70 pounds.

EXAMPLE 9

Same as example 6 except that the film thickness was 4 mils thick before and after transfer. The resulting first two samples exhibited the following adhesive strengths: Sample 1, 5.25; sample 2, 1.20. The tuft pull strength of the third sample was tested and found to be 7.98 pounds.

EXAMPLE 10

An 8 mil thick polyethylene film supplied as "401 Resin" by Polypac was corona treated on one side. The same adhesive as in example 1 was prepared in the same manner, but to a different coating thickness. The liner-supported adhesive was then applied to the corona-treated side of the backing film to thereby transfer the adhesive onto the backing film. The adhesive coating was 10 mils thick before and after transfer. The film was then heat-bonded on its other side to Chrysler JB839 needlepunch carpeting. The resulting construction was then divided into three samples. The adhesive sides of the first samples were applied to a polypropylene substrate and allowed to dwell for 72 hours at room temperature. The two samples were then tested for adhesive strength under the following circumstances: sample 1, no further treatment; sample 2, exposure to 180 degree F. environment for 17 hours followed by a recovery time before test of 1 minute. The samples exhibited the following adhesive strengths (pounds per lineal inch): Sample 1, 4.80; sample 2, 0.87. The fiber pull strength of the third sample was tested and found to be 7.41 pounds.

EXAMPLE 11

Same as example 10 except that the film was heat bonded to General Motors Thaxton tufted carpeting. The resulting first two samples exhibited the following adhesive strengths: Sample 1, 4.39; sample 2, 0.95. The tuft pull strength of the third sample was tested and found to be 7.09 pounds.

EXAMPLE 12

Same as example 10 except that the film was heat bonded to Ford ESB-M3H50-A2 tufted carpeting. The resulting first two samples exhibited the following adhesive strengths: Sample 1, 3.92; sample 2, 0.94. The tuft pull strength of the third sample was tested and found to be 7.32 pounds.

EXAMPLE 13

Same as example 10 except that the film was 10 mils thick. The resulting first two samples exhibited the following adhesive strengths: Sample 1, 4.47; sample 2, 1.17. The tuft pull strength of the third sample was tested and found to be 6.37 pounds.

EXAMPLE 14

Same as example 11 except that the film was 10 mils thick. The resulting first two samples exhibited the following adhesive strengths: Sample 1, 4.64; sample 2, 1.15. The fiber pull strength of the third sample was tested and found to be 6.14 pounds.

EXAMPLE 15

Same as example 12 except that the film was 10 mils thick. The resulting two samples exhibited the following adhesive strengths: Sample 1, 3.87; sample 2, 0.70. The tuft pull strength of the third sample was tested and found to be 7.56 pounds.

EXAMPLE 16

A 6 mil thick coextruded film consisting of 5 mils ethylene vinyl acetate and 1 mil polypropylene supplied by Exxon was corona treated on the polypropylene side. A pressure-sensitive adhesive of a hot-melt radiation-cured type was then provided. The adhesive comprised the following base in parts by weight:

| | |
|---|---|
| 36.7 | SBS linear copolymer, about 31% styrene |
| 30.4 | Alpha pinene tackifier |
| 30.4 | Rosin ester tackifier |
| 2.4 | Compatible aromatic liquid resin |

0.9 percent by weight of trimethylolpropanetri(3-mercapto-propionate) was mixed with the foregoing as a crosslinking additive. Antioxidants were also included. The adhesive was hot-melt coated onto a release liner, and electron-beam radiated at a dosage of 50 kGy to cure. The liner-supported adhesive was then applied to the polypropylene side of the backing film to thereby transfer the adhesive onto the backing film. The adhesive coating was 8 mils thick before and after transfer. The backing film was then heat-bonded on its other side to General Motors Thaxton tufted carpeting. The resulting construction was then divided into six samples. The adhesive sides of the first five samples were applied to a polypropylene substrate and allowed to dwell for 72 hours at room temperature. The five samples were then tested for adhesive strength under the following circumstances: sample 1, no further treatment; sample 2, exposure to 180 degree F. environment for 17 hours followed by a recovery time before test of 1 minute; sample 3, exposure to 180 degrees F. environment for 17 hours followed by a recovery time before test of 5 minutes; sample 4, exposure to 210 degrees F. for 17 minutes followed by a recovery time before test of 1 minute; sample 5, exposure to 210 degrees F. for 17 minutes followed by a recovery time before test of 5 minutes. The samples exhibited the following adhesive strengths (pounds per lineal inch): Sample 1, 5.91; sample 2, 1.96; sample 3, 3.93; sample 4, 2.37; sample 5, 3.68. The tuft pull strength of the sixth sample was tested and found to be 4.77 pounds.

EXAMPLE 17

Same as example 16 except that the film was heat-bonded to General Motors "Tower" carpeting, consisting of tufts and a woven fabric carrier, but in which the tufts are not locked in the absence of a film backing. The samples exhibited the following adhesive strengths (pounds per lineal inch): Sample 1, 5.45; sample 2, 2.30; sample 3, 3.39; sample 4, 2.01; sample 5, 4.73. The tuft pull strength of the sixth sample was tested and found to be 4.77 pounds.

It will be understood by those skilled in the art that the lowered adhesions exhibited by the second and higher samples in the above examples are to be expected in view of their exposure to elevated temperatures, as set forth. Generally, adhesive strengths of about a pound or more may be considered reasonably acceptable after exposure to these adverse conditions, but samples falling below this value are included for completeness.

It should be evident that this disclosure is by way of example and that various changes may be made by adding, modifying or eliminating details without departing from the fair scope of the teaching contained in this disclosure. The invention is therefore not limited to the particular details of this disclosure except to the extent that the following claims are necessarily so limited.

What is claimed is:

1. The process of making adherent film-backed carpeting comprising, corona-treating a side of a film to be used as backing for the carpeting, said film comprising a film of polymeric material having the capacity to stiffen a web of carpeting when the film is heat-laminated to the carpeting with the polymeric film material in directly contacting and bonding relation with the carpeting, coating a pressure-sensitive adhesive onto a release liner, applying the adhesive side of the adhesive-coated liner to the corona-treated side of the backing film whereby the adhesive is transfer-coated onto the backing film and a construction is produced comprising a backing film and a release-linered adhesive on the corona-treated side of the backing film, and then presenting the other side of the backing-film to a web of carpeting and heat laminating the film thereto and thereby stiffening the same by bringing the polymeric film material into directly contacting and bonding relation with the carpeting to thereby, in a single pass of the carpeting and at a single station in the carpet-manufacturing line, utilize said construction to both reinforce the carpeting with a polymeric film backing and provide the carpeting with a release-linered pressure-sensitive adhesive.

2. The process of making adherent film-backed carpeting comprising, in a first step, assembling a construction comprising (1) a backing-film comprising a film of polymeric material having the capacity to stiffen a web of carpeting when the film is heat-laminated to the carpeting with the polymeric film material in directly contacting and bonding relation with the carpeting, (2) a release liner, and (3) a pressure-sensitive adhesive between the backing-film and the release liner, and then, in a second step, heat-laminating the backing film to a web of carpeting and thereby stiffening the same by bringing the polymeric film material into directly contacting and bonding relation with the carpeting to thereby, in a single pass of the carpeting and at a single station in the carpet-manufacturing line, reinforce the carpeting with a polymeric film backing and provide the carpeting with a release-linered pressure-sensitive adhesive, said first assembling step including the steps of coating said pressure-sensitive adhesive onto said release liner, and applying the adhesive side of the adhesive-coated liner to the backing film whereby the adhesive is thereby transfer-coated onto the backing film.

3. The process of making adherent film-backed carpeting comprising, in a first step, assembling a construction comprising (1) a backing-film comprising a film of polymeric material having the capacity to stiffen a web of carpeting when the film is heat-laminated to the carpeting with the polymeric film material in directly contacting and bonding relation with the carpeting, (2) a release liner, and (3) a pressure-sensitive adhesive between the backing-film and the release liner, and then, in a second step, heat-laminating the backing film to a web of carpeting and thereby stiffening the same by bringing the polymeric film material into directly contacting and bonding relation with the carpeting to thereby, in a single pass of the carpeting and at a single station in the carpet-manufacturing line, reinforce the carpeting with a polymeric film backing and provide the carpeting with a release-linered pressure-sensitive adhesive, said first assembling step including the steps of corona-treating a side of the backing film, coating said pressure-sensitive adhesive onto said release liner, and applying the adhesive side of the adhesive-coated liner to the corona-treated side of the backing film whereby the adhesive is thereby transfer-coated onto the backing film.

* * * * *